US006967646B2

(12) United States Patent
Hosoi et al.

(10) Patent No.: US 6,967,646 B2
(45) Date of Patent: Nov. 22, 2005

(54) DISPLAY CONTROLLER AND DISPLAY APPARATUS

(75) Inventors: Kenichiro Hosoi, Fukuroi (JP); Masanori Ando, Fukuroi (JP); Naruhiro Sato, Fukuroi (JP)

(73) Assignees: Pioneer Corporation, Tokyo-To (JP); Shizuoka Pioneer Corporation, Shizuoka-Ken (JP)

( * ) Notice: Subject to any disclaimer, the term of this patent is extended or adjusted under 35 U.S.C. 154(b) by 307 days.

(21) Appl. No.: 10/186,724

(22) Filed: Jul. 2, 2002

(65) Prior Publication Data

US 2003/0011543 A1 Jan. 16, 2003

(30) Foreign Application Priority Data

Jul. 11, 2001 (JP) ..... P2001-211309

(51) Int. Cl.[7] ..... G09G 5/00; G09G 3/28

(52) U.S. Cl. ..... 345/204; 345/60; 345/63; 345/66

(58) Field of Search ..... 345/204, 690, 345/60, 63, 66; 315/169.4, 582–587; 313/582–587

(56) References Cited

U.S. PATENT DOCUMENTS 5,757,343 A 5/1998 Nagakubo
5,943,032 A * 8/1999 Nagaoka et al. ..... 345/63
5,956,014 A 9/1999 Kuriyama et al.
6,072,448 A * 6/2000 Kojima et al. ..... 345/63
6,414,658 B1 * 7/2002 Tokunaga ..... 345/63
2001/0020923 A1 * 9/2001 Homma ..... 345/60
2002/0130825 A1 * 9/2002 Kang ..... 345/60

FOREIGN PATENT DOCUMENTS

JP 9-244575 9/1997

* cited by examiner

*Primary Examiner*—Jimmy H. Nguyen
(74) *Attorney, Agent, or Firm*—Sughrue Mion, PLLC

(57) ABSTRACT

A display controller is disclosed which, when controlling the luminance of an image to be displayed, by controlling the number of sustain pulses forming each of display signals used for a preset display period, stores in a characteristic information storage section a plurality of different characteristic information each for changing the number of sustain pulses in function of the average brightness level of each of video signals corresponding to the image to be displayed, selects one of the stored characteristic information using a selection section, detects the average brightness level of each of the video signals Sin externally supplied for displaying the image, using an APL detection section, sets the number of sustain pulses to be used to display the image by referring to the selected one of the characteristic information based on the detected average brightness level, and applies the set numbers of sustain pulses to a PDP to display the image.

3 Claims, 5 Drawing Sheets

DISPLAY CONTROLLER AND DISPLAY APPARATUS

BACKGROUND OF THE INVENTION

1. Field of the Invention

The present invention generally relates to display controllers and display apparatuses. More particularly, the invention is directed to a display controller that controls the luminance of an image to be displayed, by changing the number of pulses forming each of display signals applied during a preset display period, and to a display device including the display controller, such as a plasma display panel (PDP).

2. Description of Related Art

Plasma display panels (PDPs) are attracting much attention as a self light-emission, high-luminance display apparatus.

Many conventional PDPs are driven to display video images under luminance control for changing the number of pulses forming each of display signals applied during one preset display period, such as one field period.

In such a PDP driven under the above control, when the average brightness level (often called the "average pulse level (APL)") of any of externally supplied video signals corresponding to an image to be displayed exceeds a prescribed threshold, a automatic brightness limit (ABL) process is often performed, which limits the luminance of the video signal at which to display the image on the PDP. The ABL process is performed mainly to reduce power consumption in the PDP.

In a specific luminance limiting scheme, some video signals whose APL is equal to or greater than the prescribed threshold have the number of their sustain pulses gradually decreased with increasing APL, and other video signals whose APL is smaller than the prescribed threshold have the number of their sustain pulses kept unchanged. That is, the number of sustain pulses applied to the PDP during a given field period, i.e., the total number of sustain pulses applied during subfield periods into which a single field period is divided, is gradually reduced for any video signal whose APL is equal to or greater than the prescribed threshold, and left unchanged otherwise.

In a conventional display controller for such a PDP, the relationship between the APL and the number of sustain pulses for use in the ABL process is fixed at the time of the PDP's fabrication, for example.

Due to the APL-versus-sustain pulse relationship being fixed for the ABL process in the conventional display controller, no such selective control is available as to allow a user to selectively operate the PDP to increase the lifetime of the PDP by preventing the image burn or decrease the power consumption in the PDP, thus making the PDP functionally inflexible and hence less user-friendly.

SUMMARY OF THE INVENTION

The invention has been made to overcome the above problem, and an object of the invention is, therefore, to provide a display controller with such improved flexibility and user-friendliness as to enable a user to select a desired one of PDP operating functions, and a display device including the display controller.

The above object of the present invention can be achieved by a display controller. The display controller that controls a luminance of an image to be displayed, by controlling a number of pulses forming each of display signals used for a preset display period, is provided with: a storage device, such as a characteristic information storage section, which stores a plurality of different characteristic information, each information serving to change the number of pulses in function of an average brightness level of each of video signals corresponding to the image to be displayed; a selecting device, such as a selection section, which selects one of the stored characteristic information; a brightness detecting device, such as an APL detection section, which detects the average brightness level of each of the video signals externally supplied for displaying the image; a setting device, such as a control section, which sets the number of pulses to be used to display the image by referring to the selected one of the characteristic information based on the detected average brightness level; and a driving device, such as sustain drivers, which applies the display signals, each being formed of the set number of pulses, to a display device to display the image on the display device.

According to the display controller, the display controller permits the user to select a desired characteristic information item used to control the luminance of an image based on the detected average brightness level, and hence the user can be provided with improved flexibility in selecting a desired function when using a display apparatus including the display controller.

In one aspect of the display controller, said plurality of characteristic information include at least two of: a first characteristic information in which the number of pulses is so set that a power consumption in the display device takes a prescribed value; a second characteristic information in which the number of pulses is so set that the power consumption takes a value lower than the prescribed value set by the first characteristic information; and a third characteristic information in which the number of pulses is set at such a fixed value that the power consumption takes a value equal to or smaller than the prescribed value.

According to this aspect, the display controller permits the user to select one of a plurality of types of characteristic information items tailored to decrease power consumption and improve the lifetime of the display device, and hence the display device can further increase its lifetime and decrease its power consumption.

The above object of the present invention can be achieved by a display apparatus. The display apparatus that controls a luminance of an image to be displayed, by controlling a number of pulses forming each of display signals used for a preset display interval, is provided with: a display device, such as a PDP, which displays the image to be displayed thereon; a storage device, such as a characteristic information storage section, which stores a plurality of different characteristic information, each information serving to change the number of pulses in function of an average brightness level of each of video signals corresponding to the image to be displayed; a selecting device, such as a selection section, which selects one of the stored characteristic information; a brightness detecting device, such as an APL detection section, which detects the average brightness level of each of the video signals externally supplied for displaying the image; a setting device, such as a control section, which sets the number of pulses to be used to display the image by referring to the selected one of the characteristic information based on the detected average brightness level; and a driving device, such as sustain drivers, which applies the display signals, each being formed of the set number of pulses, to the display device to display the image on the display device.

According to the display apparatus, the display apparatus permits the user to select a desired one of a plurality of types of characteristic information items, and hence a display device can be realized, which provides the user with improved flexibility in selecting its functions and which is hence more user-friendly.

DETAILED DESCRIPTION OF THE PREFERRED EMBODIMENTS

In the following description, a preferred embodiment of the invention refers to a display controller that drives a plasma display panel (PDP) by applying drive signals based on externally input video signals.

Figure 1:
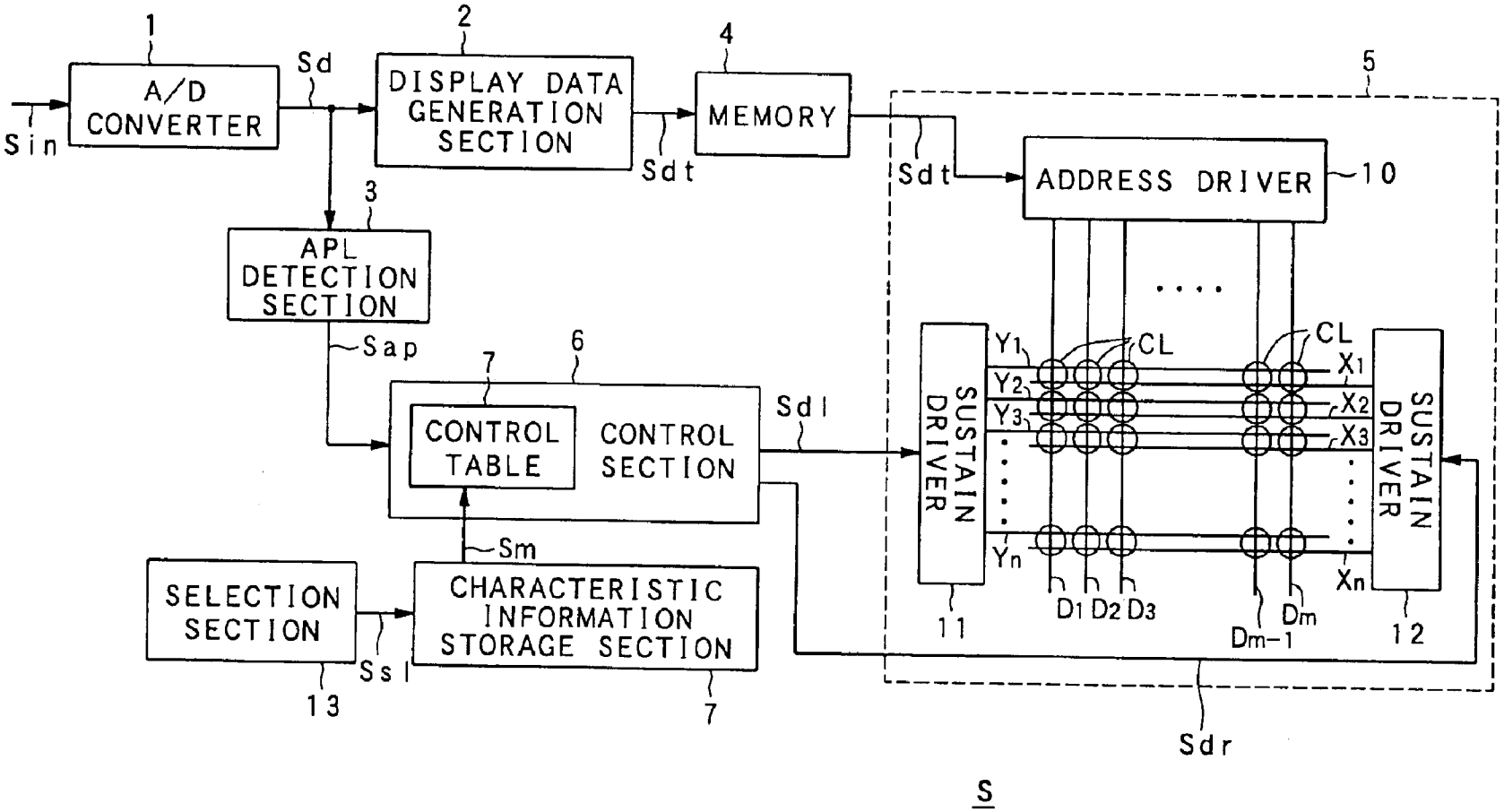
FIG. 1 is a block diagram showing the general configuration of a display system according to an embodiment of the invention.

Referring now to FIG. 1, a display system S according to the preferred embodiment generally comprises an analog-to-digital (A/D) converter 1, a display data generation section 2, an APL detection section 3 as the brightness detecting device, a memory 4, a PDP 5 as the display device, a control section 6 as the setting device, a characteristic information storage section 7 as the storage device, and a selection section 13 as the selecting device.

The PDP 5 has a typical PDP configuration, including an address driver 10, and sustain drivers 11 and 12 as the driving device. From the address driver 10, an array of column electrodes D1 to Dm extends over a display area of the PDP 5 in a vertical direction. From the sustain driver 11, an array of row electrodes Y1 to Yn extends over the display area in a horizontal direction, and so does an array of row electrodes X1 to Xn from another sustain driver 12. The row electrodes Y1 to Yn are formed in parallel with the respective row electrodes X1 to Xn, and each pair of adjacent row electrodes Y and X constitutes a single horizontal line. A cell CL as a luminous element is formed at a location where each one of column electrodes D crosses corresponding ones of row electrodes Y and X.

Figure 2:
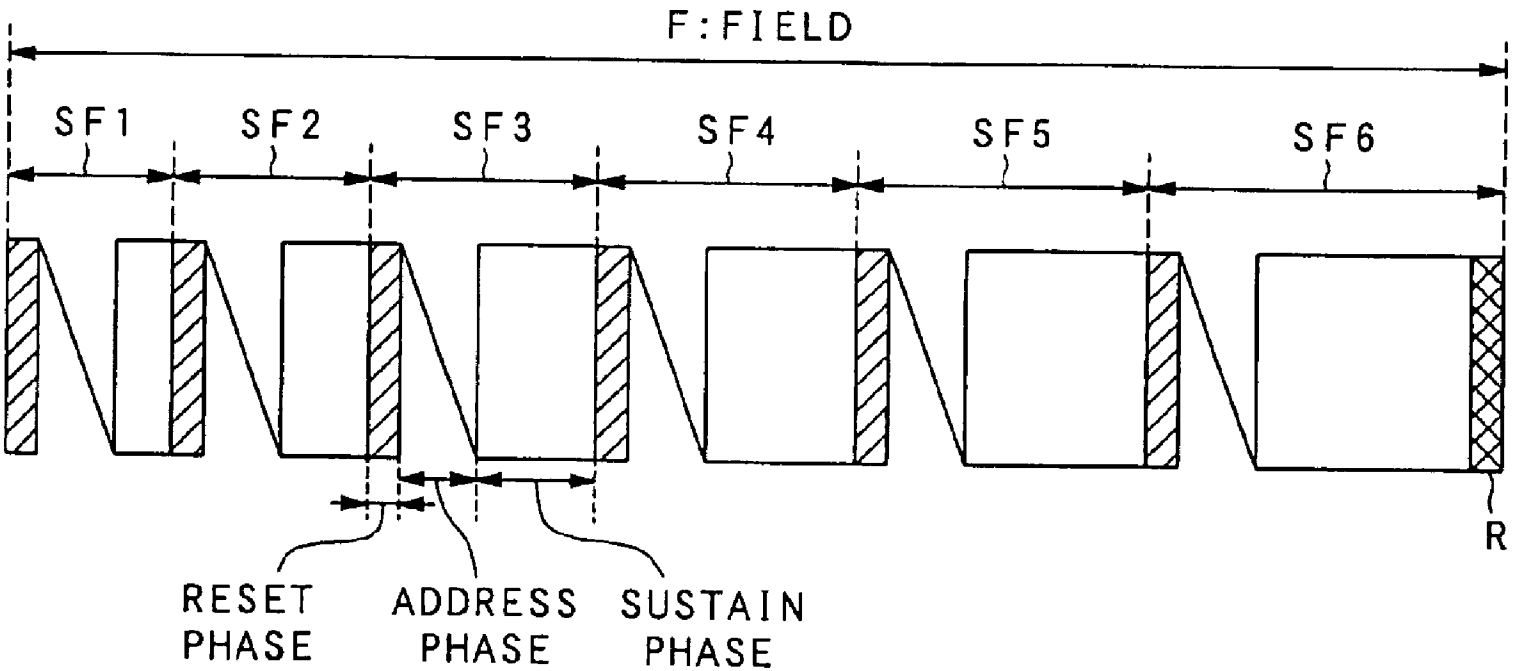
FIG. 2 is a diagram illustrative of the operating principle of a PDP.

Referring next to FIG. 2, the driving principle of the PDP 5 will be described.

As shown in FIG. 2, in the display system S according to the embodiment, one field F of an image to be displayed, which corresponds to input video signals, is divided into 6 subfields SF1 to SF6. Each subfield SF corresponds to one bit of 6-bit display data generated from each of the video signals as described below. The durations of the respective subfields SF of a given field F are programmed so that each individual cell is illuminated on the display area for an amount of time proportionally weighted for gradation control.

The PDP 5 is driven to implement gradation-controlled display by composing each subfield SF of a reset phase for resetting charges remaining at all the cells CL from the previous illumination, an address phase for selecting column electrodes D, and a sustain phase for applying sustain pulses to row electrodes X and Y to illuminate the corresponding cells. Here, the above-mentioned weighting is implemented by proportionally increasing the sustain phase durations of the respective subfields SF (in other words, the number of sustain pulses applied during each sustain phase is increased) as shown in FIG. 2. At the tail of each field F (i.e., upon end of the sustain phase of the subfield SF6), an erase phase R is arranged for initializing wall charges stored at all the cells CL.

In operation, each of the input video signals Sin corresponding to the image to be displayed on the PDP 5 is digitized into, for example, an 8-bit signal by the A/D converter 1, and applied to both the display data generation section 2 and the APL detection section 3 as a digital video signal Sd.

The display data generation section 2, in turn, compresses the received 8-bit digital video signal Sd by 2 bits (more specifically, through an error diffusion process or a dither process, for example), to generate 6-bit display data Sdt that corresponds to the respective subfields SF shown in FIG. 2, and temporarily stores the generated data in the memory 4.

Then, the 6 bits of display data Sdt corresponding to the respective subfields SF are read from the memory 4 for each horizontal line over the PDP 5 screen during the address phase (see FIG. 2), and supplies the read data bits to the address driver 10.

The address driver 10, in turn, generates data pulses corresponding to the respective bits of display data Sdt for the horizontal line, and applies the generated pulses to the corresponding column electrodes D1 to Dm.

In the meantime, the APL detection section 3 detects the APL of each received digital video signal Sd, and applies the detected signal Sap to the control section 6.

Figure 3:
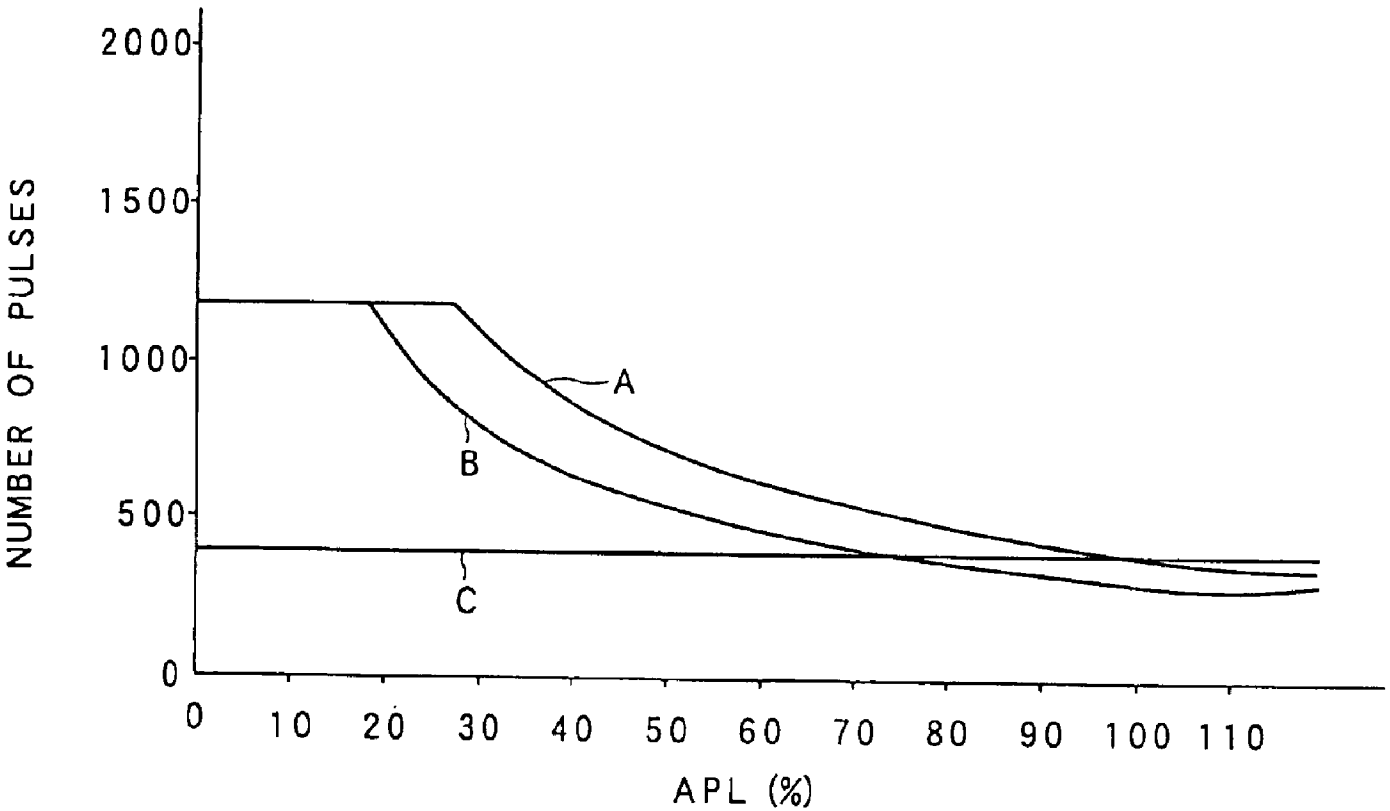
FIG. 3 is a diagram showing examples of characteristic curves according to the embodiment.

The characteristic information storage section 7 stores characteristic curves such as shown in FIG. 3 as characteristic information Sm for selecting a PDP operating function. Each characteristic curve is indicative of the relationship between the APL and the number of sustain pulses (i.e., the total number of sustain pulses applied during one given field F). When a user selects a desired characteristic curve using the selection section 13 as described below, a selected signal Ss1 indicative of the selected curve is fed to the characteristic information storage section 7, which then stores the characteristic curve selected by the user in a control table T within the control section 6 as the characteristic information Sm.

More specifically, when the display controller is shipped from a factory, the control table T stores a standard characteristic curve A shown in FIG. 3 as default. When wishing to prevent the image burn at each cell CL, the user may select a characteristic curve C shown in FIG. 3 which provides a fixed number of pulses. The user may also select a characteristic curve B shown in FIG. 3 in order to reduce power consumption. It should be noted that the curve B is arranged to implement a lower power consumption than the standard curve A while keeping peak luminance.

The control section 6 then calculates the total number of sustain pulses to be applied during the field F period which corresponds to the APL indicated by each detected signal Sap based on the selected characteristic curve stored as the characteristic information Sm in the control table T, calculates the number of sustain pulses to be applied during each of the subfields SF, based on the calculated total number, and generates drive signals Sd1 and Sdr for generating the sustain pulses in such waveforms as to be described below, based on the calculated result. The generated drive signals Sd1 and Sdr are applied to the respective sustain drivers 11 and 12.

Figure 4:
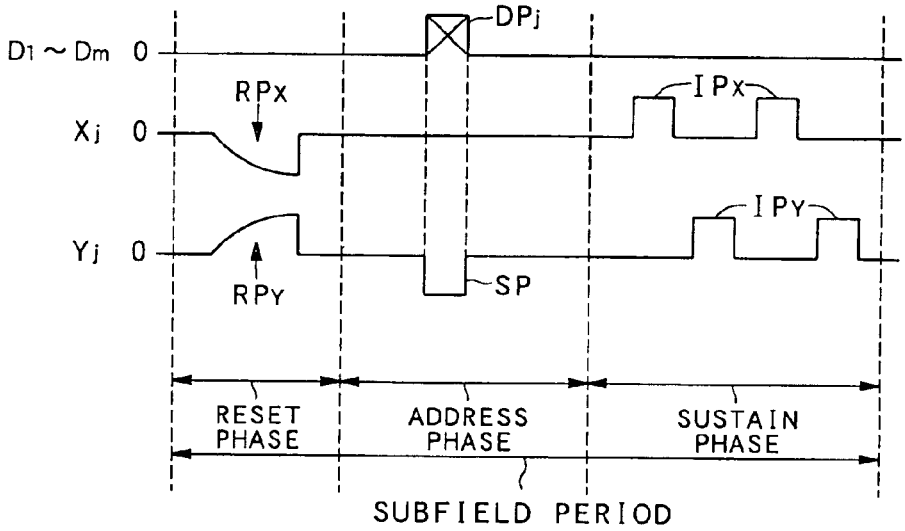
FIG. 4 is a timing chart showing specific drive signal waveforms.

Referring next to FIG. 4, the waveforms of the signals to be applied to the column electrodes D1 and Dm and the row electrodes X1 to Xn and Y1 to Yn will be described.

As shown in FIG. 4, during the reset phase of each subfield SF, negative reset pulses RPx shown as the second waveform from top are applied to all the row electrodes X simultaneously, and concurrently therewith, positive reset pulses RPy shown as the third waveform from top are applied to all the row electrodes Y simultaneously. As a result, reset discharges take place simultaneously between pairs of row electrodes X and Y corresponding to all the cells CL, each pair constituting a single horizontal line, and upon end of the reset discharges, wall charges are stored at all the cells CL.

Next, during the address phase, scan pulses SP shown as the third waveform from top of FIG. 4 are applied to the row electrodes Y one horizontal line at a time, and in synchronism therewith, data pulses DP (see the topmost waveform of FIG. 4) corresponding to the same horizontal line are applied to the column electrodes D1 to Dm. It should be noted that the data pulses DP are applied to turn the cells CL off, not to turn them on. At cells supplied with the data pulses DP in synchronism with the scan pulses SP, selective erase discharges take place to erase the wall charges stored during the reset phase, thereby leaving these cells CL nonilluminating.

On the other hand, at cells CL not supplied with the data pulses DP in synchronism with the scan pulses SP, no selective erase discharge takes place, thereby keeping the wall charges which are stored during the reset phase to leave these cells CL illuminating.

Then, upon completion of the cell selection operation for all the horizontal lines, a sustain phase starts, during which the weighted numbers of sustain pulses IPx and IPy corresponding to the respective subfields SF are applied to the row electrodes X and Y, respectively. For each cell CL illuminating due to the residual wall charges, a sustain discharge occurs every time the sustain pulses IPx and IPy are applied, for continuous illumination. In contrast, for each cell CL nonilluminating due to the wall charges erased, no discharge takes place any longer even if sustain pulses IPx and IPy are applied thereto.

By repeating this driving operation including the reset, address, and sustain phases on a subfield SF basis, gradation-controlled display corresponding to the input video signals Sin is implemented on the PDP 5.

In this embodiment, the numbers of sustain pulses IPx and IPy to be applied during the sustain phase are changed in function of the detected APL, by referring to the corresponding characteristic curve stored in the control table T.

Figure 5:
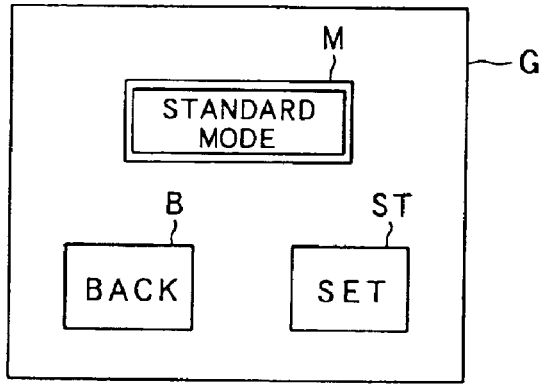
FIG. 5 is a diagram showing a specific example of a selecting operation.

Referring next to FIG. 5, an operation of selecting a characteristic curve stored in the characteristic information storage section 7 will be described.

During the selecting operation, a selection screen G such as shown in FIG. 5 appears on a display part (not shown) of the selection section 13. The selection screen G includes a move button B used to move to a step other than the selection step, a selection button ST used to perform the selection step, and a check screen M used to display the currently selected characteristic curve. Every time the selection button ST is pressed, the characteristic curves are cyclically changed one after another. As the button ST is so pressed, the names respectively indicative of the characteristic curves A to C of FIG. 4 are displayed on the check screen M one at a time, so that the user can check the characteristic curve selected by the current operation.

As described in the foregoing, the display system S according to this embodiment operates to allow a characteristic curve to be selected based on detected APLs, thus providing the user with increased flexibility in selecting a desired PDP operating function when the user uses the PDP 5.

In addition, the fact that the user can select a desired one of a plurality of types of characteristic curves tailored to decrease power consumption and increase lifetime (i.e., prevent image burn) can implement a longer lifetime and a lower power consumption for the PDP 5.

As some alternatives to the case shown in FIG. 3 in which three characteristic curves are available for selection, the number of characteristic curves may be increased to include, for example, one having a larger maximum number of sustain pulses, and ones having rates of change different from those shown in FIG. 3.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 2001-211309 filed on Jul. 11, 2001 including the specification, claims, drawings and summary is incorporated herein by reference in its entirety.

What is claimed is:

1. A display controller that controls a luminance of an image to be displayed, by controlling a number of pulses forming each of display signals used for a preset display period, comprising:

a storage device which stores a plurality of different characteristic information, each information serving to change the number of pulses in function of an average brightness level of each of video signals corresponding to the image to be displayed;

a selecting device which allows a user to select one of the stored characteristic information;

a brightness detecting device which detects the average brightness level of each of the video signals externally supplied for displaying the image;

a setting device which sets the number of pulses to be used to display the image by referring to the selected one of the characteristic information based on the detected average brightness level; and a driving device which applies the display signals, each being formed of the set number of pulses, to a display device to display the image on the display device.

2. A display controller according to claim 1, wherein said plurality of characteristic information include at least two of a first characteristic information in which the number of pulses is so set that a power consumption in the display device takes a prescribed value;

a second characteristic information in which the number of pulses is so set that the power consumption takes a value lower than the prescribed value set by the first characteristic information; and a third characteristic information in which the number of pulses is set at such a fixed value that the power consumption takes a value equal to or smaller than the prescribed value.

3. A display apparatus that controls a luminance of an image to be displayed, by controlling a number of pulses forming each of display signals used for a preset display interval, comprising:

a display device which displays the image to be displayed thereon;

a storage device which stores a plurality of different characteristic information, each information serving to change the number of pulses in function of an average brightness level of each of video signals corresponding to the image to be displayed;

a selecting device which allows a user to select one of the stored characteristic information;

a brightness detecting device which detects the average brightness level of each of the video signals externally supplied for displaying the image;

a setting device which sets the number of pulses to be used to display the image by referring to the selected one of the characteristic information based on the detected average brightness level; and a driving device which applies the display signals, each being formed of the set number of pulses, to the display device to display the image on the display device.

* * * * *

UNITED STATES PATENT AND TRADEMARK OFFICE

CERTIFICATE OF CORRECTION

PATENT NO. : 6,967,646 B2
APPLICATION NO. : 10/186724
DATED : November 22, 2005
INVENTOR(S) : Kenichiro Hosoi, Masanori Ando and Naruhiro Sato It is certified that error appears in the above-identified patent and that said Letters Patent is hereby corrected as shown below:

On Title page item 73
Under Assignee:

Please delete: ~~Pioneer Corporation Tokyo To (JP); Shizuoka Pioneer Corporation, Shizuoka Ken (JP)~~; and insert: Pioneer Corporation, Tokyo-To (JP); Pioneer Display Products Corporation, Shizuoka-Ken, (JP)

Signed and Sealed this

Sixteenth Day of January, 2007

JON W. DUDAS
*Director of the United States Patent and Trademark Office*